US010248041B2

(12) United States Patent
Suzuki

(10) Patent No.: US 10,248,041 B2
(45) Date of Patent: Apr. 2, 2019

(54) DEVELOPING UNIT, IMAGE FORMING UNIT, AND IMAGE FORMING APPARATUS

(71) Applicant: Oki Data Corporation, Tokyo (JP)

(72) Inventor: Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/601,110

(22) Filed: May 22, 2017

(65) Prior Publication Data

US 2017/0343914 A1 Nov. 30, 2017

(30) Foreign Application Priority Data

May 26, 2016 (JP) ..... 2016-105343

(51) Int. Cl.

*G03G 15/01* (2006.01)
*G03G 21/16* (2006.01)
*G03G 21/18* (2006.01)

(52) U.S. Cl.

CPC ..... *G03G 15/0105* (2013.01); *G03G 21/16* (2013.01); *G03G 21/1807* (2013.01); *G03G 21/1821* (2013.01); *G03G 21/1825* (2013.01); *G03G 21/1842* (2013.01)

(58) Field of Classification Search

CPC ..... G03G 21/1817; G03G 21/1821; G03G 21/1825; G03G 21/1842; G03G 15/0105; G03G 21/1807

See application file for complete search history.

(56) References Cited

U.S. PATENT DOCUMENTS 5,678,121 A * 10/1997 Meetze, Jr. ..... G03G 15/0872 399/12
6,115,571 A * 9/2000 Kobayashi ..... G03G 21/1821 206/515
2011/0280616 A1* 11/2011 Itabashi ..... G03G 21/1623 399/110

FOREIGN PATENT DOCUMENTS

JP 2015068843 A 4/2015
JP 2017097259 A * 6/2017 ..... G03G 21/1647

OTHER PUBLICATIONS

Machine Translation of JP 2017-097259. dated Jun. 1, 2017.*

* cited by examiner

*Primary Examiner* — Carla J Therrien
(74) *Attorney, Agent, or Firm* — Panitch Schwarze Belisario & Nadel LLP

(57) ABSTRACT

A developing unit includes a body and a displacement member. The displacement member is to be held by the body in a first mode in a first mounting state, and is to be held by the body displaceably between the first mode and a second mode in a reversible fashion in a second mounting state. The first mounting state is a state in which a first toner cartridge is mounted on the developing unit. The second mounting state is a state in which a second toner cartridge is mounted on the developing unit.

14 Claims, 13 Drawing Sheets

DEVELOPING UNIT, IMAGE FORMING UNIT, AND IMAGE FORMING APPARATUS

CROSS REFERENCE TO RELATED APPLICATIONS

The present application claims priority from Japanese Patent Application No. 2016-105343 filed on May 26, 2016, the entire contents of which are hereby incorporated by reference.

BACKGROUND

The technology relates to a developing unit, an image forming unit, and an image forming apparatus.

An image forming apparatus that forms an image on a medium, for example, by an electrophotography scheme includes a developing unit that allows a toner cartridge to be mounted on the developing unit. The toner cartridge contains a toner and feeds the toner to the developing unit. For example, reference is made to Japanese Unexamined Application Publication No. 2015-68843.

SUMMARY

An image forming apparatus such as the image forming apparatus described above may not perform favorable image formation when a toner cartridge of a color other than a predetermined color is mounted at a predetermined position.

It is desirable to provide an image forming apparatus that is able to perform favorable image formation, and a developing unit and an image forming unit that are preferably mounted on the foregoing image forming apparatus.

According to one embodiment of the technology, there is provided a developing unit including a body and a displacement member. The displacement member is to be held by the body in a first mode in a first mounting state, and is to be held by the body displaceably between the first mode and a second mode in a reversible fashion in a second mounting state. The first mounting state is a state in which a first toner cartridge is mounted on the developing unit. The second mounting state is a state in which a second toner cartridge is mounted on the developing unit.

According to one embodiment of the technology, there is provided an image forming unit including a toner cartridge and a developing unit. The developing unit allows the toner cartridge to be mounted on the developing unit detachably. The developing unit includes a body and a displacement member. The displacement member is to be held by the body in a first mode in a mounting state, and is to be held by the body displaceably between the first mode and a second mode in a reversible fashion in a detached state. The mounting state is a state in which the toner cartridge is mounted on the developing unit. The detached state is a state in which the toner cartridge is detached from the developing unit.

According to one embodiment of the technology, there is provided an image forming apparatus including a first developing unit and a frame. The first developing unit allows a first toner cartridge to be mounted on the first developing unit detachably. The frame includes a first attachment part that allows the first developing unit to be attached to the first attachment part detachably. The first developing unit includes a first body and a first displacement member. The first displacement member is to be held by the first body in a first mode in a first mounting state, and is to be held by the first body displaceably between the first mode and a second mode in a reversible fashion in a detached state. The first mounting state is a state in which the first toner cartridge is mounted on the first developing unit. The detached state is a state in which the first toner cartridge is detached from the first developing unit.

DETAILED DESCRIPTION

Some example embodiments of the technology are described below in detail with reference to the drawings. It is to be noted that the description below is given of mere specific examples of the technology, and the technology is therefore not limited thereto. Further, the technology is not limited to factors such as arrangements, dimensions, and dimension ratios of components illustrated in the respective drawings. The description is given in the following order.

1. Example Embodiment

A developing unit including a displacement member a mode of which is varied depending on whether a toner cartridge has a protrusion, an image forming unit provided with the developing unit, and an image forming apparatus provided with the developing unit 2. Modifications

1. Example Embodiment

[Overall Configuration of Image Forming Apparatus]

Figure 1:
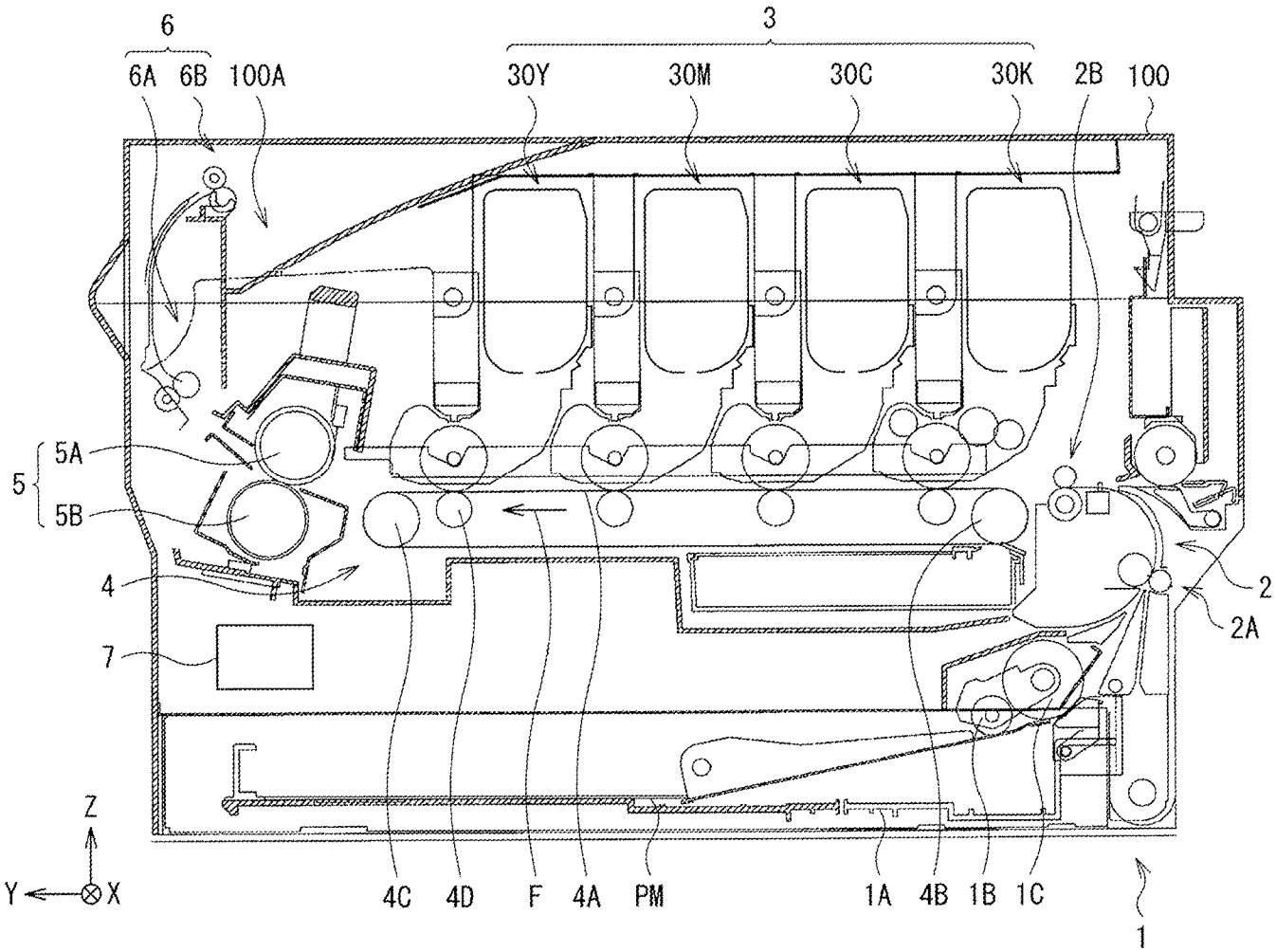
FIG. 1 schematically illustrates an example of an overall configuration of an image forming apparatus according to one example embodiment of the technology.

FIG. 1 schematically illustrates an example of an overall configuration of an image forming apparatus according to one example embodiment of the technology. This image forming apparatus may correspond to an "image forming apparatus" according to one specific but non-limiting embodiment of the technology. The image forming apparatus may be, for example, a printer that forms an image by an electrophotography scheme on a medium PM on which printing is to be performed, for example. Non-limiting examples of the medium PM may include a sheet and a film. Non-limiting examples of the image to be formed may include a color image. The image forming apparatus may include, inside a housing 100, a medium feeding unit 1, a conveying unit 2, an image former 3, a transferring unit 4, a fixing unit 5, and a discharging unit 6, and a controller 7. The controller 7 may control respective operations of the medium feeding unit 1, the conveying unit 2, the image former 3, the transferring unit 4, the fixing unit 5, and the discharging unit 6.

As used herein, the term "conveyance path" may refer to a path along which the medium PM is to be conveyed. The term "upstream" and its variants may refer to a position, in the conveyance path, that is in a direction toward the medium feeding unit 1 or is closer to the medium feeding unit 1 compared with a certain component that may be any of components of the image forming apparatus. The term "downstream" and its variants may refer to a position, in the conveyance path, that is in a direction opposite to the direction toward the medium feeding unit 1 or is farther from the medium feeding unit 1 compared with a certain component that may be any of components of the image forming apparatus. The term "conveyance direction F" may refer to a direction in which the medium PM travels along the conveyance path, i.e., a direction from the upstream toward the downstream. The term "width direction" may refer to a direction that is parallel to the medium PM conveyed along the conveyance path and is orthogonal to the conveyance direction F. The width direction may be an X-axis direction illustrated in FIG. 1, for example. The term "length" may refer to a dimension in the conveyance direction F. The term "width" may refer to a dimension in the width direction.

[Medium Feeding Unit 1]

The medium feeding unit 1 may feed the medium PM one by one to the conveying unit 2. The medium feeding unit 1 may include a cassette 1A, a pick-up roller 1B, and a feeding roller 1C, for example. The cassette 1A may contain a plurality of media PM in a stacked manner. The cassette 1A may be attached detachably to a lower part of the image forming apparatus, for example. The pick-up roller 1B and the feeding roller 1C may sequentially allow the media PM contained in the cassette 1A to be fed to the conveyance path that leads to the conveying unit 2. The pick-up roller 1B and the feeding roller 1C each may perform a rotation operation on the basis of the control performed by the controller 7. The pick-up roller 1B and the feeding roller 1C may perform the rotation operation in a direction in which the medium PM is fed toward the conveying unit 2 that is located downstream of the pick-up roller 1B and the feeding roller 1C. The pick-up roller 1B may be disposed at a position at which the pick-up roller 1B is able to be brought into contact with an upper surface of the medium PM on the top of the stacked media PM. The feeding roller 1C may be disposed downstream of the pick-up roller 1B.

[Conveying Unit 2]

The conveying unit 2 may convey the medium PM fed from the medium feeding unit 1 to the transferring unit 4 while controlling a skew of the medium PM. The conveying unit 2 may include a pair of registration rollers 2A and a pair of registration rollers 2B, for example.

[Image Former 3]

Figure 7:
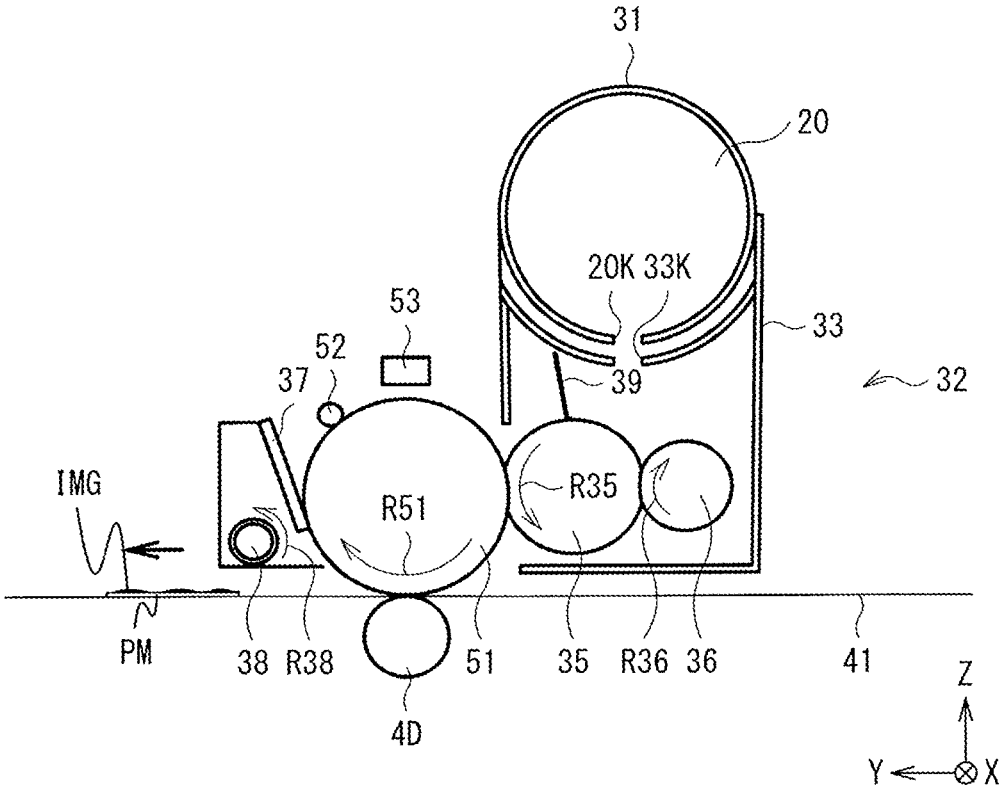
FIG. 7 schematically illustrates an example of an inner configuration of the image forming unit illustrated in FIG. 1.

The Image former 3 may form a toner image IMG on the medium PM conveyed from the conveying unit 2 as illustrated in FIG. 7 described later. Referring to FIG. 1, the image former 3 may include four image forming units, i.e., image forming units 30Y, 30M, 30C, and 30K, for example. The image forming units 30Y, 30M, 30C, and 30K each may form the toner image IMG, i.e., an image, of a corresponding color by means of a toner of the corresponding color. Specifically, the image forming units 30Y, 30M, 30C, and 30K may form the toner images IMG of yellow, magenta, cyan, and black, by means of a yellow toner, a magenta toner, a cyan toner, and a black toner, respectively. In the image former 3, the image forming units 30K, 30C, 30M, and 30Y may be disposed in order in the conveyance direction F from the upstream toward the downstream, for example. It is to be noted that, herein, the four image forming units 30Y, 30C, 30M, and 30K may be collectively referred to as an "image forming unit 30" in a case where the four image forming units 30Y, 30C, 30M, and 30K are not differentiated from each other. The image forming unit 30 may correspond to an "image forming unit" according to one specific but non-limiting embodiment of the technology.

The foregoing toner of each of the colors may include agents such as a predetermined coloring agent, a predetermined release agent, a predetermined electric charge control agent, and a predetermined treatment agent, for example. Components of the respective agents described above may be mixed as appropriate or subjected to a surface treatment. The toner may be thus manufactured. The coloring agent, the release agent, and the electric charge control agent out of the foregoing agents may serve as internal additives. Further, an additive such as silica and titanium oxide may be included as an external additive, and resin such as polyester resin may be included as binding resin. As the coloring agent, an agent such as a dye and a pigment may be used solely, or a plurality of agents such as a dye and a pigment may be used in any combination. The image forming unit 30 may be described later in greater detail.

[Transferring Unit 4]

The transferring unit 4 may be also referred to as a transfer belt unit. The transferring unit 4 may include a transfer belt 4A, a driving roller 4B, an idle roller 4C, and a transferring roller 4D. The driving roller 4B may drive the transfer belt 4A. The idle roller 4C may be driven in accordance with the driving roller 4B. The transferring roller 4D may face a photosensitive drum 51 with the transfer belt 4A in between. The driving roller 4B and the idle roller 4C each may be a substantially-cylindrical member that is rotatable around a rotation shaft. The rotation shaft may extend in the width direction. The transferring unit 4 may be a mechanism that conveys, in the conveyance direction F, the medium PM conveyed from the conveying unit 2, and sequentially transfers, onto the surface of the medium PM, the toner images IMG formed by the respective image forming units 30Y, 30M, 30C, and 30K.

The transfer belt 4A may be an endless elastic belt that is made of a resin material such as polyimide resin, for example. The transfer belt 4A may be stretched by the driving roller 4B and the idle roller 4C. In other words, the transfer belt 4A may lie from the driving roller 4B to the idle roller 4C while being stretched. The driving roller 4B may be driven to rotate in a direction in which the medium PM is conveyed, on the basis of the control performed by the controller 7. The driving roller 4B may thereby cause the transfer belt 4A to rotate circularly. The driving roller 4B may be disposed upstream of the image forming unit 30. The idle roller 4C may adjust tension applied to the transfer belt 4A by means of biasing force provided by a biasing member. The idle roller 4C may rotate in a direction same as the rotation direction of the driving roller 4B. The idle roller 4C may be disposed downstream of the image forming unit 30.

The transferring roller 4D may electrostatically transfer the toner images IMG formed in the respective image forming units 30Y, 30M, 30C, and 30K onto the medium PM while conveying the medium PM in the conveyance direction F by rotating in a direction opposite to the rotation direction of the photosensitive drum 51. The transferring roller 4D may be made of a foamed electrically-semiconductive elastic rubber material, for example.

[Fixing Unit 5]

The fixing unit 5 may apply heat and pressure to the toner image IMG on the medium PM that has passed the transferring unit 4, and thereby fix the toner image IMG onto the medium PM. The fixing unit 5 may include an upper roller 5A and a lower roller 5B, for example.

The upper roller 5A and the lower roller 5B each may include a heater as a heat source, and serve as a heating roller that applies heat to the toner image IMG formed on the medium PM. Non-limiting examples of the heater may include a halogen lamp. The upper roller 5A may perform a rotation operation in the direction in which the medium PM is conveyed, on the basis of the control performed by the controller 7. The heat source in each of the upper roller 5A and the lower roller 5B may receive a bias voltage, and thereby control the temperature of a surface of the corresponding one of the upper roller 5A and the lower roller 5B. The foregoing bias voltage may be controlled by the controller 7. The lower roller 5B may so face the upper roller 5A that a contact is provided between the upper roller 5A and the lower roller 5B. The lower roller 5B may thus serve as a pressurizing roller that applies pressure onto the toner image IMG on the medium PM. The lower roller 5B may preferably include a surficial layer made of an elastic material.

[Discharging Unit 6]

The discharging unit 6 may discharge, to the outside, the medium PM on which the toner image IMG is fixed by the fixing unit 5. The discharging unit 6 may include conveying rollers 6A and 6B, for example. The conveying rollers 6A and 6B may discharge the medium PM to the outside via the conveyance path, and allow the discharged medium PM to be stocked in an external stacker 100A. The conveying rollers 6A and 6B each may perform a rotation operation in the direction in which the medium PM is conveyed, on the basis of the control performed by the controller 7.

[Configuration of Image Forming Unit 30]

A description is given below of an example of a detailed configuration of the image forming unit 30.

Figure 2:
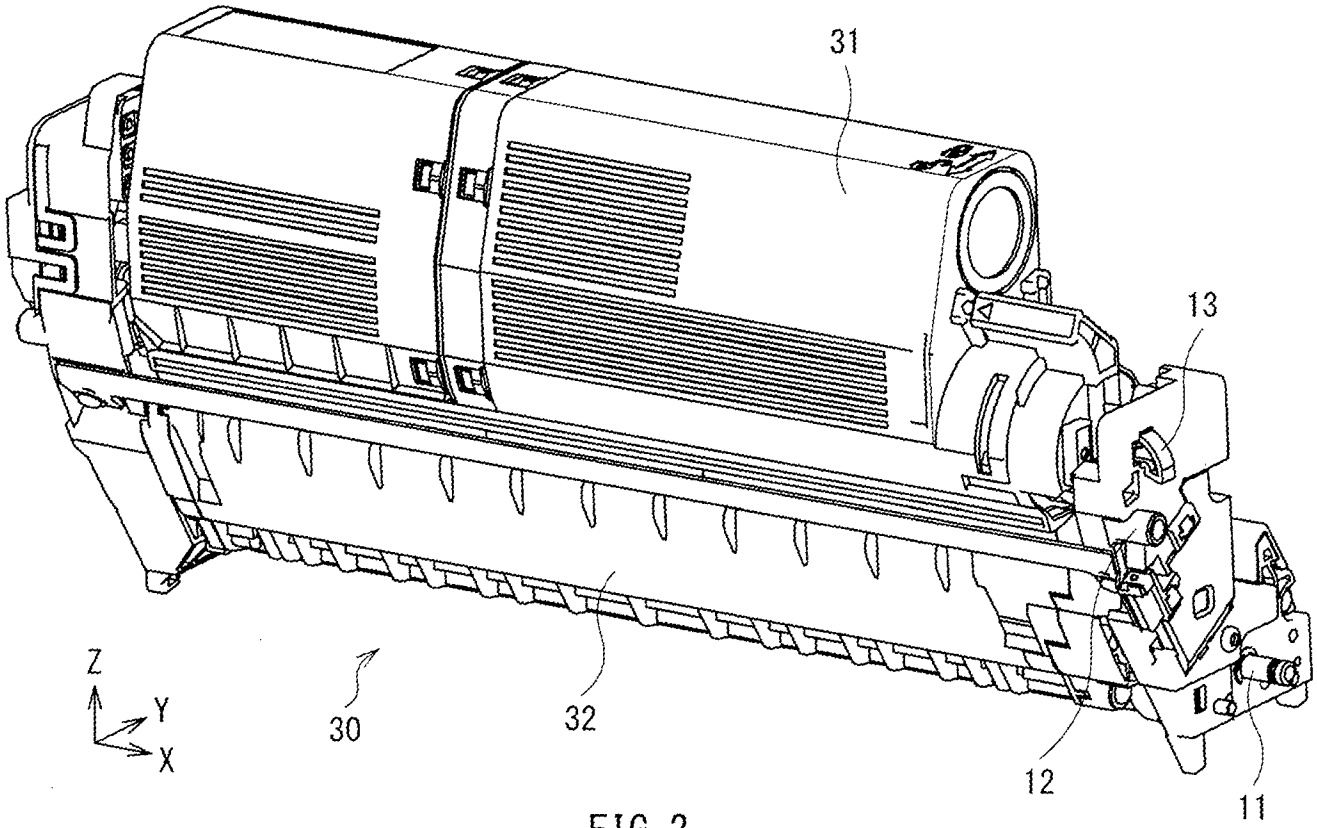
FIG. 2 is a perspective view of an example of an appearance of an image forming unit illustrated in FIG. 1.

Referring to FIG. 2, the image forming unit 30 includes a toner cartridge 31 and a developing unit 32 on which the toner cartridge 31 is to be mounted. FIG. 2 is a perspective view of an example of an appearance of the image forming unit 30. The image forming unit 30 has a configuration that allows for state transition between an example detached state and an example mounting state. The example detached state is a state in which the toner cartridge 31 is detached from the developing unit 32. The example mounting state is a state in which the toner cartridge 31 is mounted on the developing unit 32. The foregoing example detached state may correspond to a "detached state" according to one specific but non-limiting embodiment of the technology. The foregoing example mounting state may correspond to a "Mounting state" according to one specific but non-limiting embodiment of the technology.

[Toner Cartridge 31]

Figure 3:
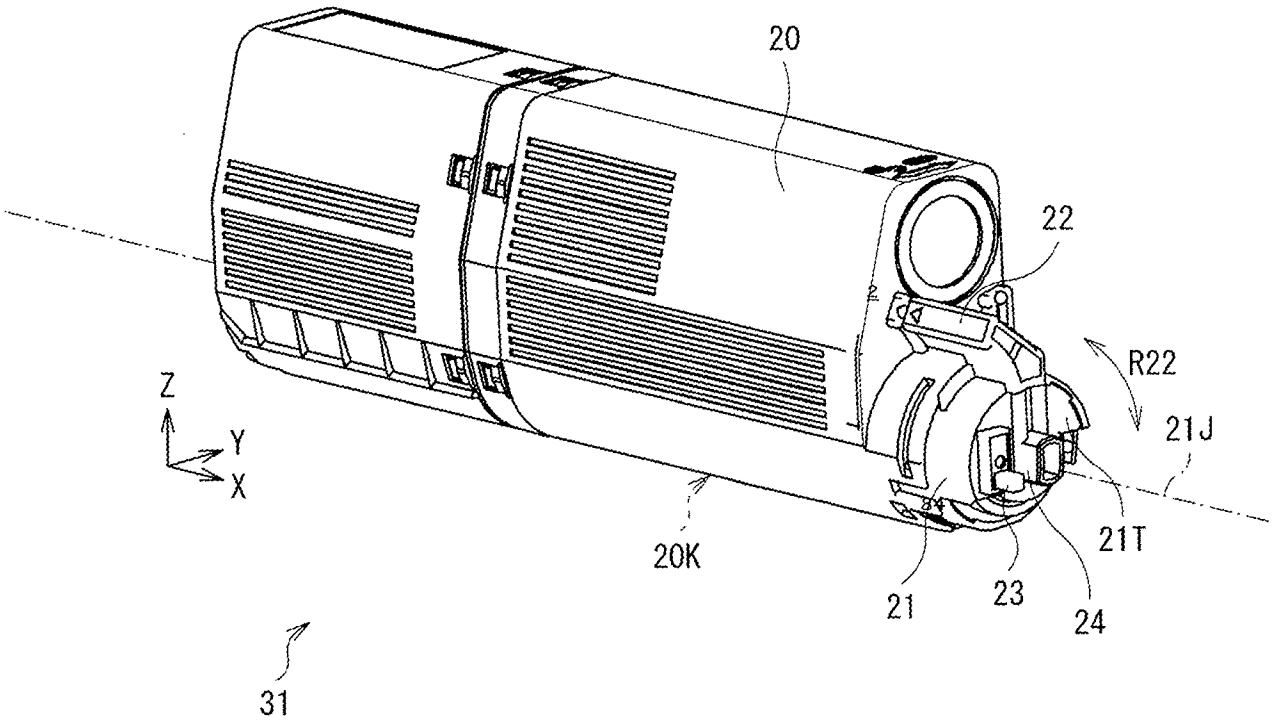
FIG. 3 is a perspective view of an example of an appearance of a toner cartridge illustrated in FIG. 2.

FIG. 3 illustrates an example of an appearance of any of toner cartridges 31M, 31C, and 31K. The toner cartridges 31M, 31C, and 31K may be containers that contain the magenta toner, the cyan toner, and the black toner, respectively. A toner cartridge 31Y may be a container that contains the yellow toner, and has a configuration similar to the configuration of each of the toner cartridges 31M, 31C, and 31K except that the toner cartridge 31Y does not have a lockout pin 23. Hence, the toner cartridges 31Y, 31M, 31C, and 31K may be hereinafter collectively referred to as a "toner cartridge 31" without distinguishing the toner cartridges 31Y, 31M, 31C, and 31K from each other for description of parts other than the lockout pin 23.

The toner cartridge 31 may include a toner container 20, a rotating member 21, and a lever 22. The toner container 20 may be able to contain the toner. The toner container 20 may have a cylindrical shape, and extend in the width direction, i.e., the X-axis direction. The toner cartridges 31M, 31C, and 31K each may further include the lockout pin 23. The rotating member 21 may have one end that is contained in the toner container 20, and the other end that is exposed to the outside from one end of the toner container 20 in the width direction. The lockout pin 23 may stand on an end surface 21T, of the rotating member 21, in the X-axis direction, and protrude in a +X direction. The end surface 21T of the rotating member 21 may be further provided with a post 24 that protrudes in the +X direction. The post 24 may be configured to be locked at a retainer 15 in the example mounting state in which the toner cartridge 31 is mounted on the developing unit 32. The retainer 15 is described later in greater detail. The lever 22 may be fixed to the rotating member 21. Further, referring to FIG. 7 which will be described later, a toner discharge opening 20K may be provided at a lower part of the toner container 20. The toner discharge opening 20K may be provided at a position that faces a toner feeding opening 33K of the developing unit 32 in the example mounting state. The rotating member 21 may be rotatable around a rotation axis 21J within a predetermined angular range with respect to the toner container 20. The rotation axis 21J may extend along the X axis. The rotating member 21 may thus rotate by a rotation operation of the lever 22 along an arrow R22. The rotating member 21 may open and close the toner discharge opening 20K by rotating around the rotation axis 21J that extends in the width direction.

[Developing Unit 32]

Figure 4:
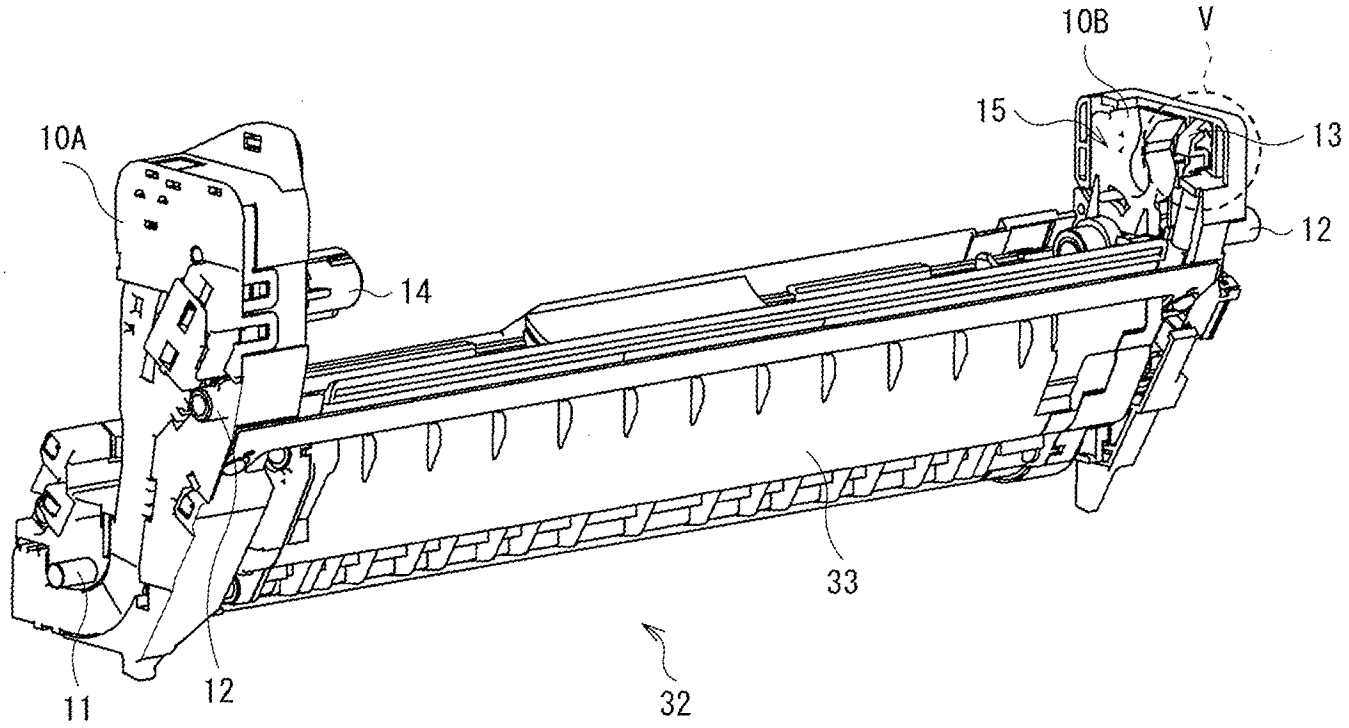
FIG. 4 is a perspective view of an example of an appearance of a developing unit illustrated in FIG. 2.
Figure 5:
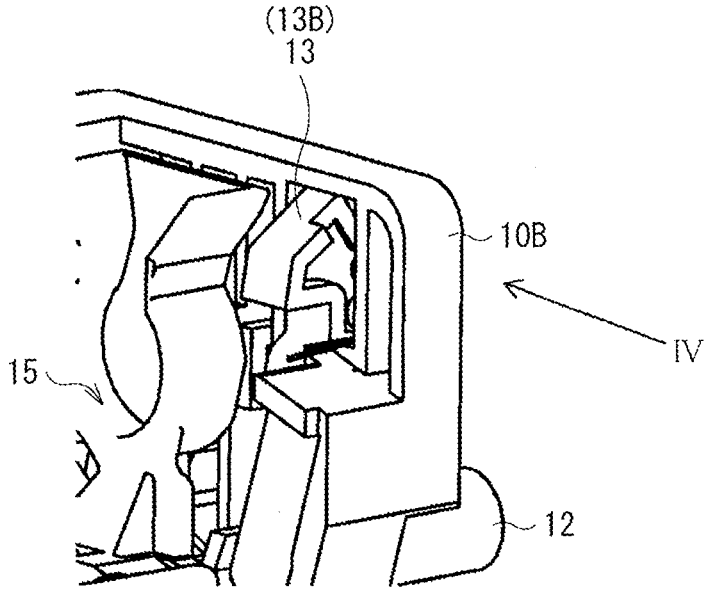
FIG. 5 is an enlarged perspective view of an example of a key part of the developing unit illustrated in FIG. 4.
Figure 6:
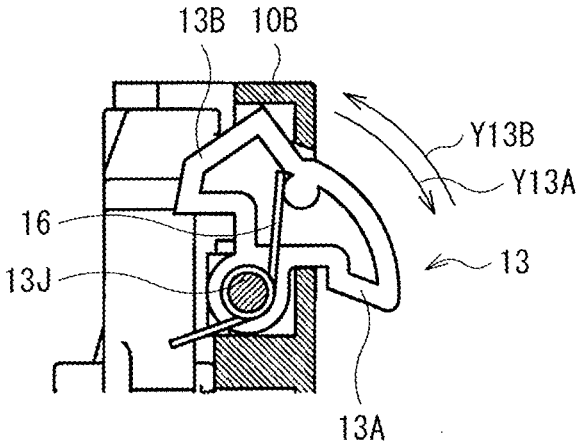
FIG. 6 is an enlarged cross-sectional view of an example of a key part of the developing unit illustrated in FIG. 4.

FIG. 4 is a perspective view of an example of an appearance of the developing unit 32. FIG. 5 is an enlarged perspective view of part surrounded by a dashed line V in FIG. 4. FIG. 6 illustrates an example of a configuration of the part illustrated in FIG. 5 in a cross-section that is orthogonal to an arrow IV. The developing units 32 on which the respective toner cartridges 31M, 31C, and 31K are to be mounted may preferably have respective structures that are substantially the same as each other. Each of the developing units 32 may include a frame 33 and a pair of supporting plates 10A and 10B. The pair of supporting plates 10A and 10B may be provided at respective ends on both side of the frame 33 in the width direction. In this example, the frame 33 and the pair of supporting plates 10A and 10B may all together correspond to a "body" according to one specific but non-limiting embodiment of the technology. The pair of supporting plates 10A and 10B may be partially protruded from the frame 33 upward, i.e., in a +Z direction, and face each other. The toner feeding opening 33K illustrated in FIG. 7 may be provided at an upper part of the frame 33. The toner feeding opening 33K may be an opening through which the toner discharged from the toner cartridge 31 is to be fed. A surface, of the supporting plate 10A, that faces the supporting plate 10B may be provided with a post 14. The post 14 may be protruded toward the supporting plate 10B. A surface of the supporting plate 10B, that faces the supporting plate 10A may be provided with the retainer 15. The post 14 may firmly support the toner container 20. The retainer 15 may support the rotating member 21 in a rotatable manner. Further, an outer surface of each of the supporting plates 10A and 10B may be provided with standing posts 11 and 12.

The supporting plate 10B may be further provided with a lockout block 13. The lockout block 13 may be held by the frame 33 displaceably between a first example mode and a second example mode. The lockout block 13 may correspond to a "displacement member" according to one specific but non-limiting embodiment of the technology. The foregoing first example mode may correspond to a "first mode" according to one specific but non-limiting embodiment of the technology. The foregoing second example mode may correspond to a "second mode" according to one specific but non-limiting embodiment of the technology. The lockout block 13 may be a rotating member that is rotatable around a rotation shaft 13J in both of a direction indicated by an arrow Y13A and a direction indicated by an arrow Y13B that is opposite to the direction indicated by the arrow Y13A. The direction indicated by the arrow Y13A may correspond to a "first rotation direction" according to one specific but non-limiting embodiment of the technology. The direction indicated by the arrow Y13B may correspond to a "second rotation direction" according to one specific but non-limiting embodiment of the technology. The lockout block 13 is to be held by the frame 33 in the first example mode in a first example mounting state in which any of the toner cartridges 31M, 31C, and 31K is mounted on the developing unit 32. The lockout block 13 is to be held by the frame 33 displaceably between the first example mode and the second example mode in a reversible fashion in a second example mounting state in which the toner cartridge 31Y is mounted on the developing unit 32. The first example mode may be, for example, a mode in which the lockout block 13 rotates in the direction indicated by the arrow Y13A and part or all of the lockout block 13 is protruded from the supporting plate 10B to the outside, i.e., toward opposite side to the supporting plate 10A, as illustrated in FIG. 6. The part of the lockout block 13 to be protruded from the supporting plate 10B may be the end 13A, for example. The second example mode may be, for example, one of: a mode in which the lockout block 13 rotates in the direction indicated by the arrow Y13B, and the end 13A of the lockout block 13 is not protruded from the supporting plate 10B; and a mode in which the lockout block 13 rotates in the direction indicated by the arrow Y13B, and the end 13A is protruded from the supporting plate 10B by an amount that is smaller than an amount by which the end 13A is protruded from the supporting plate 10B in the first example mode. In the second example mode, an end 13B of the lockout block 13 may be protruded toward inside of the supporting plate 10B, i.e., in a direction to be closer to the supporting plate 10A. The first example mounting state may correspond to a "first mounting state" according to one specific but non-limiting embodiment of the technology. The second example mounting state may correspond to a "second mounting state" according to one specific but non-limiting embodiment of the technology.

As described above, the toner cartridges 31M, 31C, and 31K each may include the lockout pin 23. The lockout block 13 may be brought into contact with the lockout pin 23 in the first example mode.

Referring to FIG. 6, the developing unit 32 may include a torsion spring 16 that biases the lockout block 13 in the direction indicated by the arrow Y13A. The torsion spring 16 may correspond to a "biasing member" according to one specific but non-limiting embodiment of the technology. The lockout block 13 may be maintained in the first example mode owing to biasing force of the torsion spring 16 in a no-load state in which no external force other than the biasing force of the torsion spring 16 is applied to the lockout block 13.

FIG. 7 illustrates an example of an inner configuration of the image forming unit 30. It is to be noted that FIG. 7 also illustrates part of the components, i.e., the transferring roller 4D, of the transferring unit 4. The developing unit 32 may include, inside the frame 33, the photosensitive drum 51, a charging roller 52, a developing roller 35, a feeding roller 36, a cleaning blade 37, a waste toner conveying spiral 38, and a doctor blade 39. The developing unit 32 may further include an exposure unit 53 that is so provided as to perform exposure on the photosensitive drum 51 from the outside of the frame 33.

The photosensitive drum 51 may be a cylindrical member with a surface, i.e., a surficial part, that is able to support an electrostatic latent image. The photosensitive drum 51 may include a photoreceptor such as an organic photoreceptor. Specifically, the photosensitive drum 51 may include an electrically-conductive supporting body and a photosensitive layer, i.e., a photoconductive layer, that covers a circumferential part, i.e., a surface, of the electrically-conductive supporting body. The electrically-conductive supporting body may include a metal pipe made of aluminum, for example. The photoconductive layer may have a structure including an electric charge generation layer and an electric charge transfer layer that are stacked in order, for example. The photosensitive drum 51 may perform a rotation operation at a predetermined circumferential velocity in a direction in which the medium PM is conveyed, on the basis of the control performed by the controller 7. Specifically, the photosensitive drum 51 may perform the rotation operation in a direction indicated by an arrow R51, for example.

The charging roller 52 may be a charging member that electrically charges the surficial part, i.e., the photosensitive layer, of the photosensitive drum 51. The charging roller 52 may be so disposed as to be in contact with the surface of the photosensitive drum 51. The charging roller 52 may include a metal shaft and an electrically-semiconductive rubber layer that covers an outer circumferential part, i.e., a surface of the metal shaft, for example. Non-limiting examples of the electrically-semiconductive rubber layer may include an electrically-semiconductive epichlorohydrin rubber layer. The charging roller 52 may perform a rotation operation, for example, in a direction same as the rotation direction of the photosensitive drum 51, on the basis of the control performed by the controller 7.

The exposure unit 53 may perform exposure on the surficial part, i.e., the photosensitive layer, of the photosensitive drum 51, and thereby form the electrostatic latent image on the surficial part, i.e., the photosensitive layer of the photosensitive drum 51. The exposure unit 53 may include a plurality of light-emitting diode (LED) light-emitting sections for each of the photosensitive drums 51. The LED light-emitting sections may be disposed side by side in the width direction, for example. Each of the LED light-emitting sections may include a light source that emits application light and a lens array. Non-limiting examples of the light source may include a light-emitting diode. The lens array may perform imaging of the emitted application light onto the surface of the photosensitive drum 51.

The developing roller 35 may have a surface supporting the toner that develops the electrostatic latent image. The developing roller 35 may be so disposed as to be in contact with the surface, i.e., the circumferential surface, of the photosensitive drum 51. The developing roller 35 may include a metal shaft and an electrically-semiconductive urethane rubber layer that covers an outer circumferential part, i.e., a surface, of the metal shaft, for example. The developing roller 35 may perform a rotation operation at a predetermined circumferential velocity in a direction opposite to the rotation direction of the photosensitive drum 51, on the basis of the control performed by the controller 7. Specifically, the developing roller 35 may perform the rotation operation in a direction indicated by an arrow R35.

The feeding roller 36 may be a feeding member that feeds the toner to the developing roller 35. The feeding roller 36 may be so disposed as to be in contact with a surface, i.e., a circumferential surface, of the developing roller 35. The feeding roller 36 may include a metal shaft and a foamed silicone rubber layer that covers an outer circumferential part, i.e., a surface, of the metal shaft, for example. The feeding roller 36 may perform a rotation operation in a direction opposite to the rotation direction of the developing roller 35, on the basis of the control performed by the controller 7. Specifically, the feeding roller 36 may perform the rotation operation in a direction indicated by an arrow R36.

The cleaning blade 37 may scrape the toner remained on the surface of the photosensitive drum 51. The cleaning blade 37 may be made of a material such as a flexible rubber material and a flexible plastic material.

The waste toner conveying spiral 38 may include spiral member and a shaft, for example. The spiral member may be provided around the shaft, for example. The waste toner conveying spiral 38 may rotate, for example, in a direction indicated by an arrow R38, on the basis of the control performed by the controller 7. The waste toner conveying spiral 38 may rotate and thereby convey, in the +X direction, the toner scraped by the cleaning blade 37.

The doctor blade 39 may control an amount by which the toner is attached to the surface of the developing roller 35.

[Structure of Housing 100]

Figure 8:
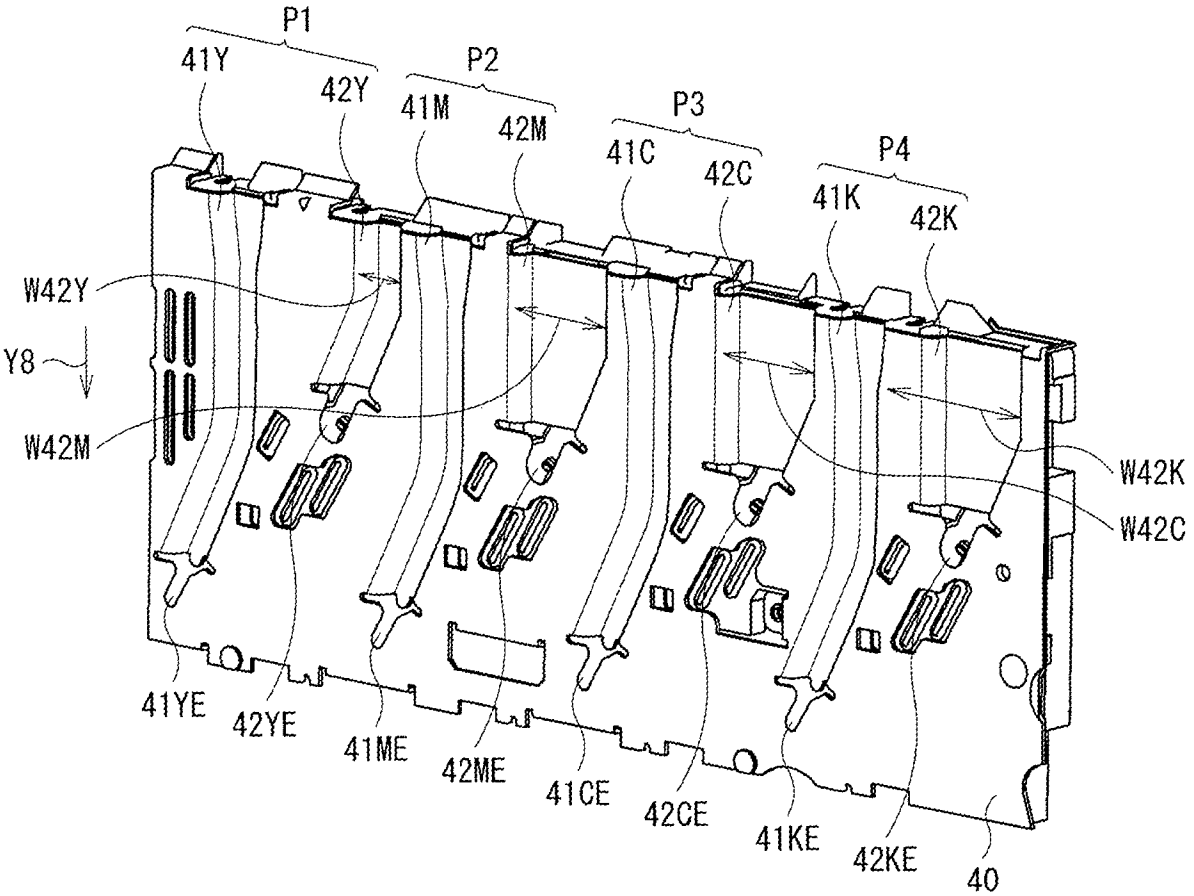
FIG. 8 is a perspective view of an example of an appearance of a plate provided in the image forming apparatus illustrated in FIG. 1.
Figure 9:
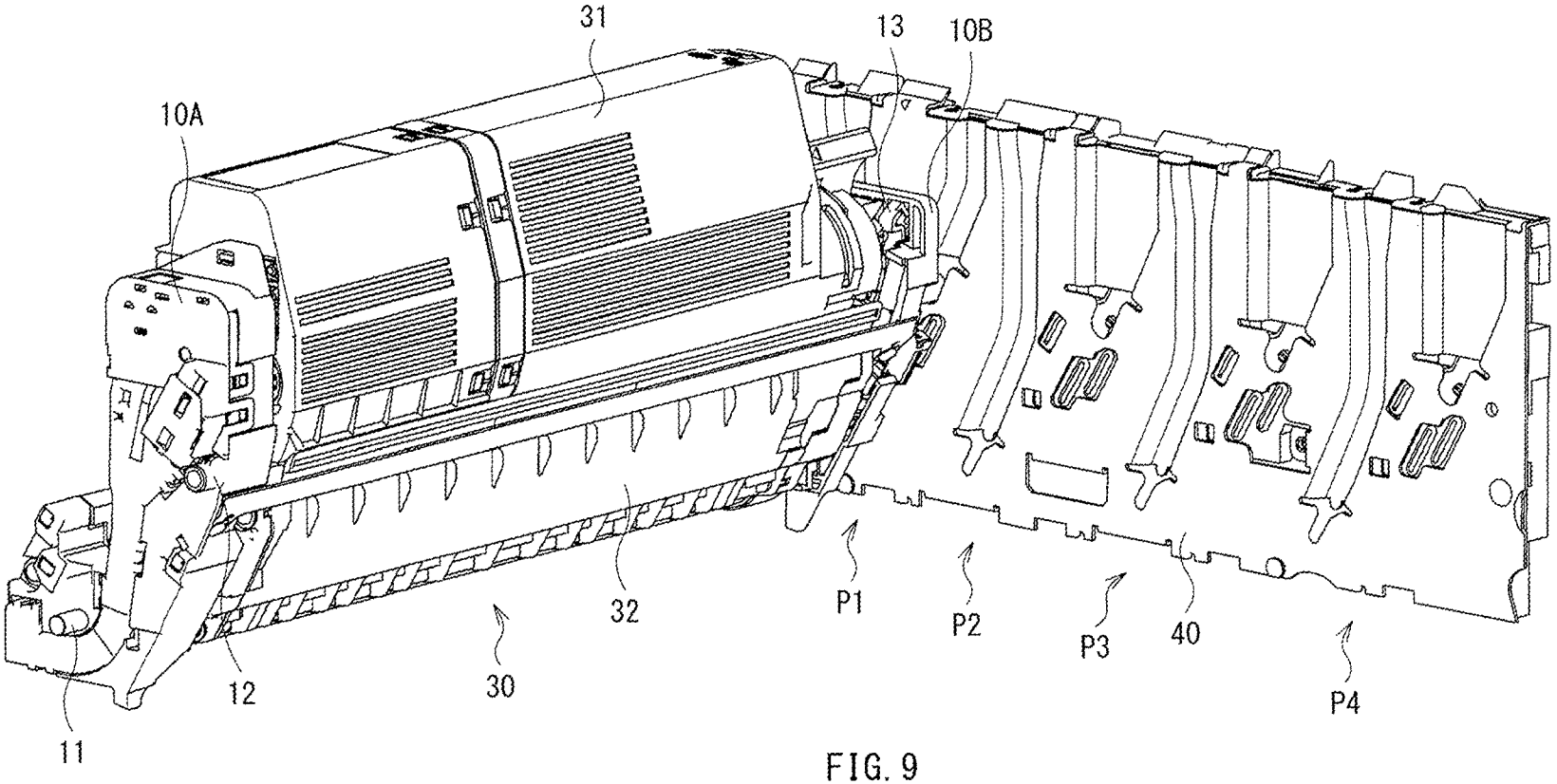
FIG. 9 is a perspective view of the plate illustrated in FIG. 8 and the image forming unit for describing a positional relationship between the plate and the image forming unit.

A pair of plates 40 may be provided on respective side surfaces on both side of the housing 100 of the image forming apparatus. The pair of plates 40 may allow the image forming unit 30 to be attached to the plates 40. FIG. 8 is a perspective view of an example of an appearance of one of the plates 40. FIG. 9 is a perspective view of the image forming unit 30 and the plate 40 for describing a positional relationship between the image forming unit 30 and the plate 40 in a state where the image forming unit 30 is attached to the housing 100 of the image forming apparatus. The pair of plates 40 may so face each other as to sandwich the image forming unit 30 in the width direction, i.e., the X-axis direction, for example. The pair of plates 40 may have respective structures that are substantially bilaterally symmetrical to each other. In other words, in the state in which the image forming unit 30 is attached to the housing 100 of the image forming apparatus, one of the pair of plates 40 may face the supporting plate 10A, and the other of the pair of plates 40 may face the supporting plate 10B. FIGS. 8 and 9 illustrate only one, of the pair of plates 40, that faces the supporting plate 10B.

Referring to FIGS. 8 and 9, the plate 40 may include four attachment parts, i.e., attachment parts P1 to P4, for example. The attachment parts P1 to P4 may allow the developing unit 32 to be attached to the respective attachment parts P1 to P4.

The attachment part P1 may have a move 41Y and a groove 42Y. Similarly, the attachment part P2 may have a groove 41M and a groove 42M. The attachment part P3 may have a groove 41C and a groove 42C. The attachment part P4 may have a groove 41K and a groove 42K. The grooves 41Y, 41M, 41C, and 41K may have depths greater than depths of the grooves 42Y, 42M, 42C, and 42K. Specifically, the deepest portion 41YE, 41ME, 410E, and 41KE of the grooves 41Y, 41M, 41C, and 41K may be located at positions lower than positions of the deepest portions 42YE, 42ME, 42CE, and 42KE of the grooves 42Y, 42M, 42C, and 42K, respectively. Further, a width W42Y, of the groove 42Y, near an upper end of the groove 42Y may be smaller than widths W42M, W42C, and W42K of the respective grooves 41M, 41C, and 41K, near upper ends of the corresponding grooves 41M, 41C, and 41K.

The attachment parts P1 to P4 each may have a configuration that allows the developing unit 32 to be inserted downward, i.e., in a direction indicated by an arrow Y8, and thereby attached to the corresponding one of the attachment parts P1 to P4, for example. Upon the insertion of the developing unit 32, the post 11 of the developing unit 32 may be inserted to any of the grooves 41Y, 41M, 41C, and 41K, and the post 12 of the developing unit 32 may be inserted to the corresponding one of the grooves 42Y, 42M, 42C, and 42K. In an attachment state where the developing unit 32 is attached to any of the attachment parts P1 to P4, the post 11 may be retained by the corresponding one of the deepest portions 41YE, 41ME, 41CE, and 41KE, and the post 12 may be retained by the corresponding one of the deepest portions 42YE, 42ME, 42CE, and 42KE. Further, to corresponding one of the grooves 42M, 42C, and 42K, the end 13A of the lockout block 13 that is protruded to the outside of the supporting plate 10B may be also inserted.

The lockout block 13 of the developing unit 32 attached to the attachment part P1 may be held by the plate 40 in the second example mode. This may prevent the toner cartridges 31M, 31C, and 31K from being mounted on the developing unit 32 attached to the attachment part P1. One reason for this may be that the end 13B of the lockout block 13 held in the second example mode is protruded toward the inside of the supporting plate 10B, and the end 13B thus protruded interferes with the lockout pin 23 provided on each of the toner cartridges 31M, 31C, and 31K. Hence, only the toner cartridge 31Y without the lockout pin 23 may be mountable on the developing unit 32 attached to the attachment part P1. In contrast, the lockout block 13 of the developing unit 32 attached to any of the attachment parts P2 to P4 may be held by the plate 40 in the first example mode. Hence, any of the toner cartridges 31Y, 31M, 31C, and 31K may be mountable on the developing unit 32 attached to any of the attachment parts P2 to P4, independently of presence or absence of the lockout pin 23.

The attachment parts P1 to P4 each may also allow the developing unit 32 on which the toner cartridge 31 is mounted in advance, i.e., the image forming unit 30, to be attached to the corresponding one of the attachment parts P1 to P4. It is to be noted that only the image forming unit 30Y having the developing unit 32 on which the toner cartridge 31Y is mounted may be attachable to the attachment part P1. In other words, each of the image forming units 30M, 30C, and 30K having the developing unit 32 on which corresponding one of the toner cartridges 31M, 31C, and 31K is mounted may not be attachable to the attachment part P1, and may be attachable only to any of the attachment parts P2 to P4. One reason for this may be as follows. That is, in each of the image forming units 30M, 30C, and 30K, the lockout block 13 may be brought into contact with the lockout pin 23 provided on each of the toner cartridges 31M, 31C, and 31K. The lockout pin 23 may thus prevent rotation of the lockout block 13 in the direction indicated by the arrow Y13B, causing the lockout block 13 to be held in the first example mode. In other words, the end 13A of the lockout block 13 held in the second example mode may be protruded to the outside of the supporting plate 10B. This may prevent the end 13A from being inserted to the groove 42Y of the attachment part P1, resulting in occurrence of interference between the end 13A and an upper end 43 of the plate 40. In contrast, the image forming unit 30Y including the developing unit 32 on which the toner cartridge 31Y is mounted may be attachable to any of the attachment parts P1 to P4. One reason for this may be as follows. That is, the toner cartridge 31Y of the image forming unit 30Y may not have the lockout pin 23. The lockout block 13 may be therefore held by the supporting plate 10B displaceably between the first example mode and the second example mode in a reversible fashion. It is to be noted that, in the example detached state where the toner cartridge 31 is detached from the developing unit 32, the lockout block 13 may be held by the supporting plate 10B displaceably between the first example mode and the second example mode in a reversible fashion.

In this example, the attachment parts P2 to P4 may correspond to a "first attachment part" according to one specific but non-limiting embodiment of the technology. The state in which the developing unit 32 is attached to any of the attachment parts P2 to P4 may correspond to a "first attachment state" according to one specific but non-limiting embodiment of the technology. The attachment part P1 may correspond to a "second attachment part" according to one specific but non-limiting embodiment of the technology. The state in which the developing unit 32 is attached to the attachment part P1 may correspond to a "second attachment state" according to one specific but non-limiting embodiment of the technology. The developing unit 32 on which any of the toner cartridges 31M, 31C, and 31K is mounted may correspond to a "first developing unit" according to one specific but non-limiting embodiment of the technology. The developing unit 32 on which the toner cartridge 31Y is mounted may correspond to a "second developing unit" according to one specific but non-limiting embodiment of the technology.

Example Workings and Example Effects

[A. Basic Operation]

The image forming apparatus may transfer the toner image IMG onto the medium PM as follows.

When print image data and a printing order are supplied from an external device to the controller 7 of the image forming apparatus in an operating state, the controller 7 may start an operation of printing the print image data in response to the printing order. Non-limiting examples of the external device may include a personal computer (PC).

For example, referring to FIG. 1, the media PM contained in the cassette 1A may be picked up one by one from the top by the pick-up roller 1B. The medium PM picked up may be conveyed by the feeding roller 1C toward the conveying unit 2 provided downstream of the feeding roller 1C while a skew of the medium PM is corrected by the feeding roller 1C. Thereafter, the medium PM may be conveyed toward the image former 3 by the two pairs of registration rollers 2A and 2B. The image former 3 may transfer the toner image IMG onto the medium PM in the following manner.

In the image former 3, the toner image IMG of each of the colors may be formed through the following electrophotographic process according to the printing order given by the controller 7. Specifically, the controller 7 may feed the toner contained in the toner container 20 of the toner cartridge 31 to the inside of the frame 33 of the developing unit 32. The controller 7 may also cause the photosensitive drum 51 to rotate in the direction indicated by the arrow R51 at a constant velocity. The charging roller 52, the developing roller 35, and the feeding roller 36 each may also start the rotation operation in the predetermined direction in accordance with the rotation of the photosensitive drum 51.

The controller 7 may apply a predetermined voltage to the charging roller 52 for each of the colors, to thereby electrically charge the surface of the photosensitive drum 51 for each of the colors uniformly. Thereafter, the controller 7 may activate the exposure unit 53, to thereby irradiate the photosensitive drum 51 for each of the colors with the light corresponding to one of color components of the print image based on the image signal. The electrostatic latent image may be thus formed on the surface of the photosensitive drum 51 for each of the colors.

The toner may be fed to the developing roller 35 via the feeding roller 36. The fed toner may be supported by the surface of the developing roller 35. The developing roller 35 may attach the toner to the electrostatic latent image formed on the photosensitive drum 51 to thereby form the toner image IMG. Further, the transferring roller 4D of the transferring unit 4 may receive a predetermined voltage, leading to generation of an electric field between the photosensitive drum 51 and the transferring roller 4D. When the medium PM passes between the photosensitive drum 51 and the transferring roller 4D while the electric field is generated between the photosensitive drum 51 and the transferring roller 4D, the toner image IMG formed on the photosensitive drum 51 may be transferred onto the medium PM.

Thereafter, the toner image IMG on the medium PM may be applied with heat and pressure by the fixing unit 5, to be thereby fixed onto the medium PM. Finally, the medium PM onto which the toner image IMG is fixed may be discharged, by the discharging unit 6, to the stacker 100A outside the image forming apparatus.

[B. Operation of Mounting Toner Cartridge 31 and Developing Unit 32]

Referring to FIGS. 10 to 17, a description is given below of an operation of mounting the toner cartridge 31 and the developing unit 32 on the image forming unit according to the present example embodiment.

Figure 10:
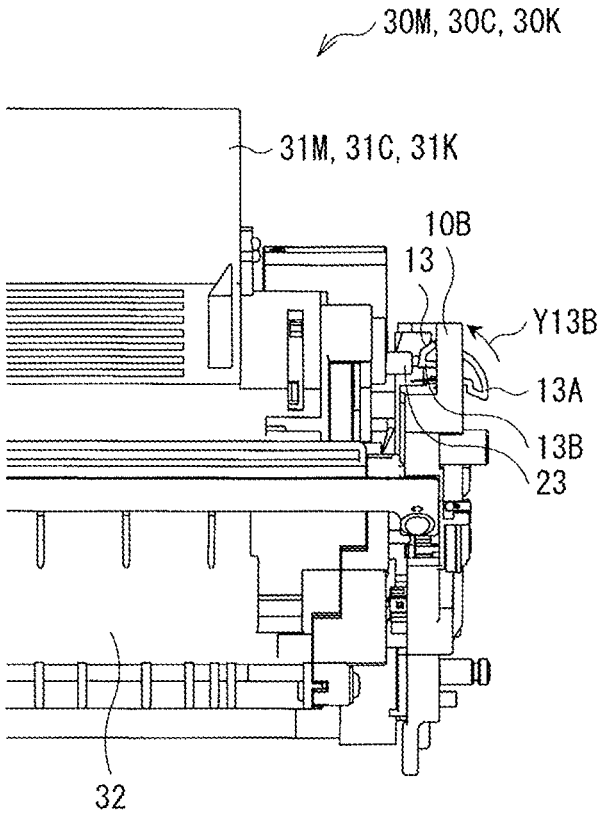
FIG. 10 is a side view of an example of a state in which a first toner cartridge is mounted on the developing unit detached from the image forming apparatus illustrated in FIG. 1.
Figure 11:
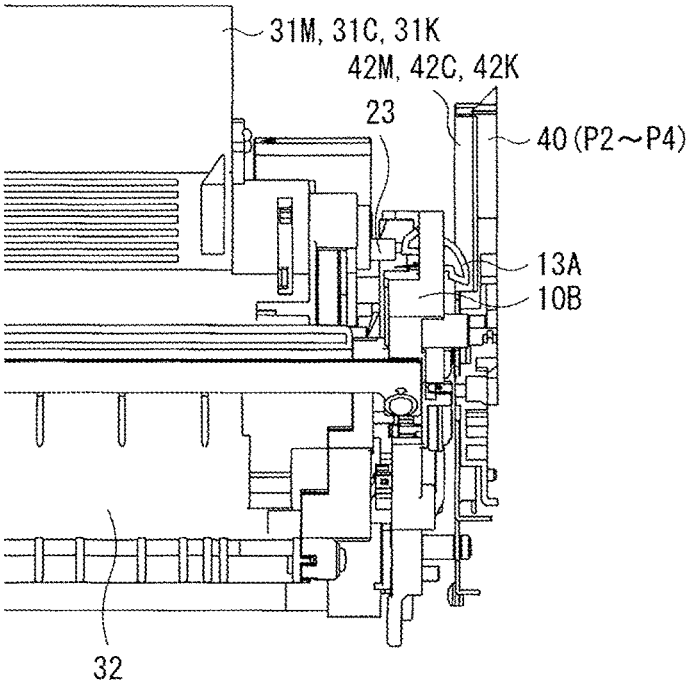
FIG. 11 is a side view of an example of a state in which the image forming unit illustrated in FIG. 10 is attached to a first attachment part, of the image forming apparatus, illustrated in FIG. 8.
Figure 12:
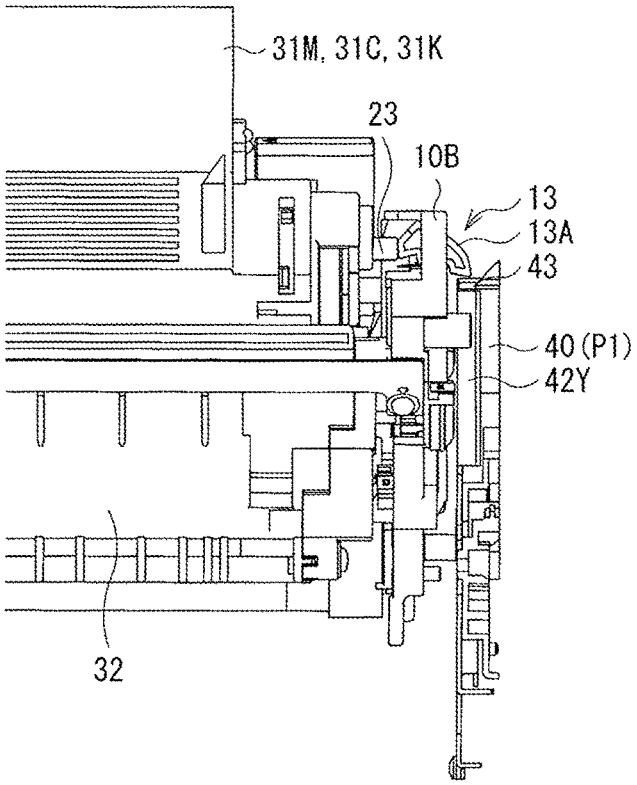
FIG. 12 is a side view of an example of a state in which the image forming unit illustrated in FIG. 10 is attached to a second attachment part, of the image forming apparatus, illustrated in FIG. 8.

First, a description is given of an operation of mounting, on the image forming apparatus, the developing unit 32 in which the toner cartridge 31 is mounted on the developing unit 32 in advance. In the first example mounting state in which any of the toner cartridges 31M, 31C, and 31K is mounted on the developing unit 32, the lockout block 13 of the developing unit 32 may be held in the first example mode. One reason for this may be as follows. That is, the end 13B of the lockout block 13 may be brought into contact with a tip of the lockout pin 23 as illustrated in FIG. 10. Accordingly, each of the image forming units 30M, 30C, and 30K may have a state in which the lockout block 13 is prevented from rotating in the direction indicated by the arrow Y13B and the end 13A of the lockout block 13 is protruded to the outside of the supporting plate 109. Hence, as illustrated in FIG. 11, any of the image forming units 30M, 30C, and 30K, may be attachable to the attachment parts P2 to P4 that respectively have the grooves 42M, 42C, and 42K into each which both of the post 12 and the end 13A of the lockout block 13 are insertable. However, as illustrated in FIG. 12, each of the image forming units 30M, 30C, and 30K may not be attachable to the attachment part P1 that has the groove 42Y having the small width. One reason for this may be that the end 13A of the protruded lockout block 13 interferes with the upper end 43 of the plate 40.

Figure 13A:
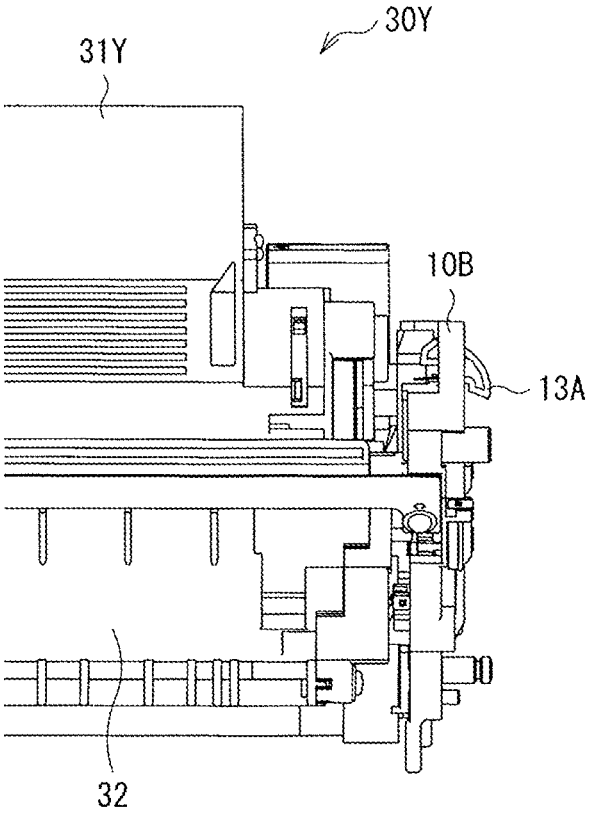
FIG. 13A is a side view of an example of a state in which a second toner cartridge is mounted on the developing unit detached from the image forming apparatus illustrated in FIG. 1.
Figure 13B:
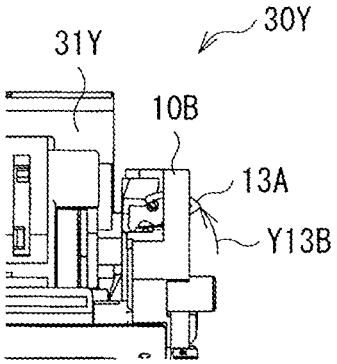
FIG. 13B is another side view of an example of the state in which the second toner cartridge is mounted on the developing unit detached from the image forming apparatus illustrated in FIG. 1.
Figure 14:
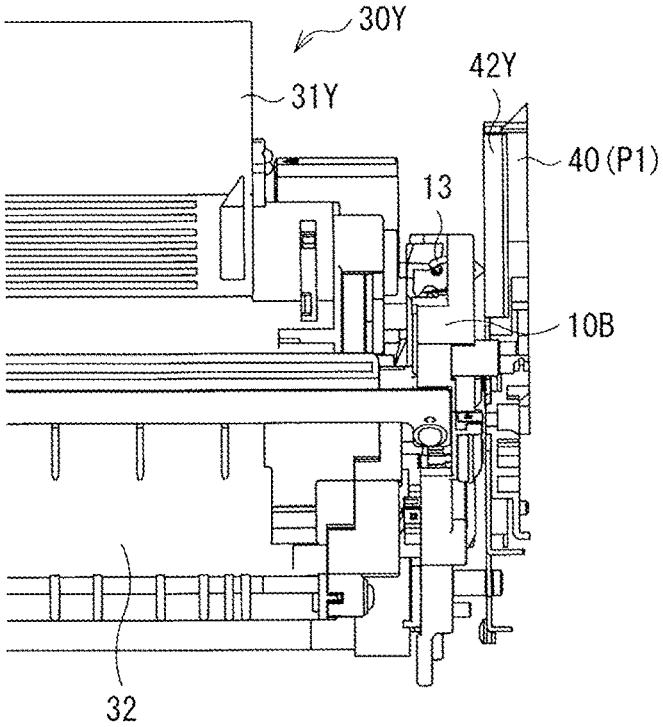
FIG. 14 is a side view of an example of a state in which the image forming unit illustrated in FIG. 13A is attached to a second attachment part, of the image forming apparatus, illustrated in FIG. 8.

In contrast, in the second example mounting state in which the toner cartridge 31Y is mounted on the developing unit 32, the lockout block 13 of the developing unit 32 may be held by the frame 33 displaceably between the first example mode and the second example mode in a reversible manner. One reason for this may be that, as illustrated in FIG. 13A, the end 13B of the lockout block 13 is not brought into contact with the toner cartridge 31Y owing to absence of the lockout pin 23. Accordingly, as illustrated in FIG. 13B, the lockout block 13 of the image forming unit 30Y is rotatable also in the direction indicated by the arrow Y13B. This may allow for the amount by which the end 13A is protruded to the outside of the supporting plate 10B to be reduced. As a result, as illustrated in FIG. 14, the image forming unit 30Y may be attachable also to the attachment part P1 that has the groove 42Y having the small width. One reason for this may be that the end 13A of the lockout block 13 is allowed to be withdrawn toward the inside of the supporting plate 10B, by which the interference between the end 13A of the lockout block 13 and the upper end 43 of the plate 40 may be avoidable.

A description is given below of an operation of mounting the toner cartridge 31 on the developing unit 32 after the developing unit 32 is mounted on the image forming apparatus in advance.

Figure 15:
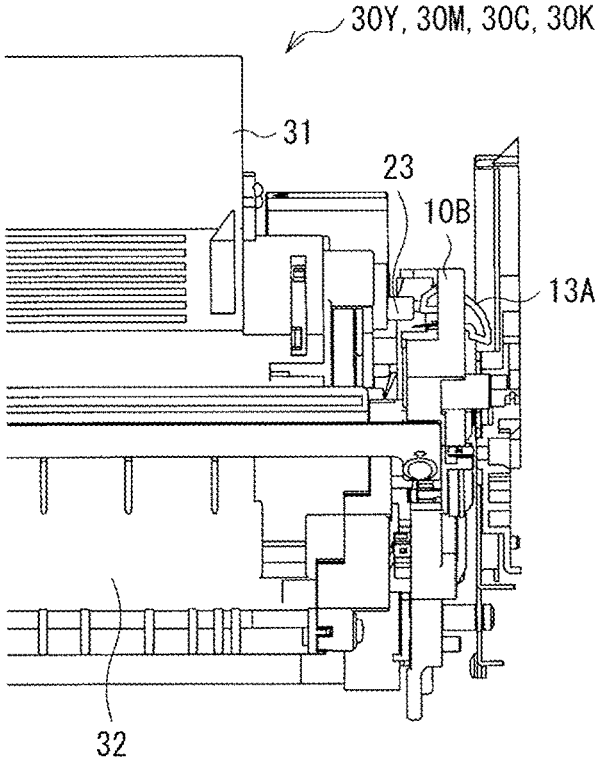
FIG. 15 is a side view of an example of a state in which one of the first and second toner cartridges is mounted on the developing unit attached to the first attachment part, of the image forming apparatus, illustrated in FIG. 8.

In this case, as illustrated in FIG. 15, the developing unit 32 attached to any of the attachment parts P2 to P4 may have a state where the end 13A of the lockout block 13 is protruded to the outside of the supporting plate 10B. Accordingly, no interference may occur between the lockout pin 23 and the lockout block 13 even if the lockout pin 23 is present. This may allow any of the toner cartridges 31Y, 31M, 31C, and 31K to be attached to the developing unit 32 attached to one of the attachment parts P2 to P4.

Figure 16:
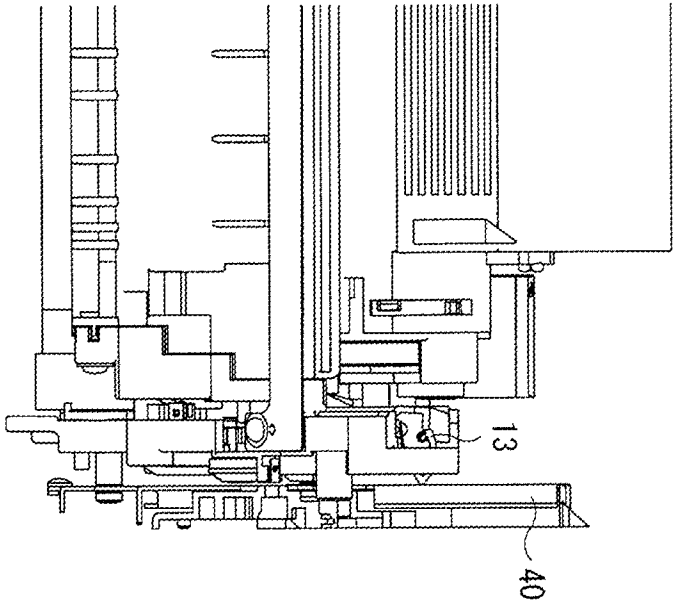
FIG. 16 is a side view of an example of a state in which the second toner cartridge is mounted on the developing unit that is attached to the second attachment part, of the image forming apparatus, illustrated in FIG. 8.
Figure 17:
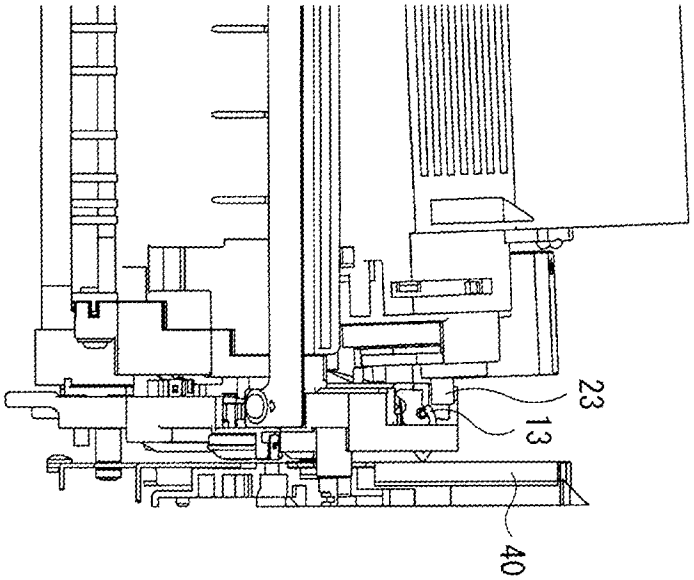
FIG. 17 is a side view of an example of a state in which the first toner cartridge is to be mounted on the developing unit that is attached to the second attachment part, of the image forming apparatus, illustrated in FIG. 8.

In contrast, as illustrated in FIG. 16 the developing unit 32 attached to the attachment part P1 may have a state in which the end 13A of the lockout block 13 is biased toward the inside of the supporting plate 10B by the inner surface of the plate 40, and the end 13B opposite to the end 13A is protruded toward the inside of the supporting plate 10B. Accordingly, the interference may occur between the lockout pin 23 and the lockout block 13 as illustrated in FIG. 17 when the lockout pin 23 is present. This may prevent each of the toner cartridges 31M, 31C, and 31K from being mounted on the developing unit 32 attached to the attachment part P1, and allow only the toner cartridge 31Y to be mounted on the developing unit 32 attached to the attachment part P1.

[C. Example Workings and Example Effects of Image Forming Apparatus]

According to the present example embodiment described above, the lockout block 13 of the developing unit 32 is held by the frame 33 in a mode that differs between the first example mounting state and the second example mounting state. The first example mounting state may be the state in which any of the toner cartridges 31M, 31C, and 31K is mounted on the developing unit 32. The second example mounting state may be the state in which the toner cartridge 31Y is mounted on the developing unit 32. For example, in the first example mounting state, the lockout block 13 may be held by the supporting plate 10B in the first example mode in which the end 13A of the lockout block 13 is protruded from the supporting plate 10B to the outside. This prevent the developing unit 32 on which any of the toner cartridges 31M, 31C, and 31K is mounted from being attached to the attachment part P1 of the image forming apparatus. In other words, the developing unit 32 having the lockout block 13 held in the first example mode is prevented from erroneously attached to a position, in the image forming apparatus, where that developing unit 32 should not be attached.

According to the present example embodiment, the developing unit 32 on which the toner cartridge 31 is not yet mounted is attachable at a predetermined position of the plate 40. In the state in which the developing unit 32 is attached to any of the attachment parts P2 to P4, which may correspond to the "first attachment state" according to one specific but non-limiting embodiment of the technology, the lockout block 13 may be held by the plate 40 of the image forming apparatus in the first example mode. In contrast, in the state in which the developing unit 32 is attached to the attachment part P1, which may correspond to the "second attachment state" according to one specific but non-limiting embodiment of the technology, the lockout block 13 may be held by the plate 40 of the image forming apparatus in the second example mode. This prevents each of the toner cartridges 31M, 31C, and 31K from being mounted on the developing unit 32 attached to the attachment part P1. In other words, it is possible to avoid erroneous mounting, on the developing unit 32 attached to the attachment part P1, of each of the toner cartridges 31M, 31C, and 31K which should not be mounted on that developing unit 32. For example, the yellow toner to be contained in the toner cartridge 31Y may have a relatively high heat resistance while the magenta toner, the cyan toner, and the black toner to be respectively contained in the toner cartridges 31M, 31C, and 31K may have thermal stability that is lower than that of the yellow toner in some cases. In this case, it may be preferable that each of the image forming units 30M, 30C, and 30K respectively having the toner cartridges 31M, 31C, and 31K be prevented from being attached to the attachment part P1 closest to the fixing unit 5 having the heat source. It is possible to prevent a certain toner cartridge 31 from being attached to an attachment part that is inappropriate for the certain toner cartridge 31 to be attached to, owing to the mechanism according to the present example embodiment.

Moreover, according to the present example embodiment, the developing units 32 may have respective structures that are the same for the respective colors. This may allow for, for example, reduction in stocks and simplification of stock control of the developing units 32. One reason for this may be that the developing unit 32 has the lockout block 13 that is displaceable in a reversible manner in accordance with the structure of the toner cartridge 31, resulting in no necessity for preparing a different structure of the developing unit for each of the colors of the toner cartridges 31 to be attached.

2. Modifications

The technology is described above referring to the example embodiments. However, the technology is not limited to the example embodiments described above, and is modifiable in various ways. For example, the foregoing example embodiments are described referring to the image forming apparatus of a primary transfer scheme, i.e., a direct transfer scheme. However, the technology is also applicable to a second transfer scheme.

Moreover, the foregoing example embodiments refer to the example case where the lockout block 13 that rotates around the rotation shaft 13J is provided as the displacement member of the developing unit; however, the technology is not limited to this example case. Alternatively, the displacement member may be a slider that is slidable in the X-axis direction, for example. The foregoing embodiments refer to the example case where, in the first example mode, the lockout pin 23 is so brought into contact with the lockout block 13 as to prevent the rotation of the lockout block 13 and that the end 13A is protruded from the supporting plate 10B; however; the technology is not limited to this example case. The technology may involve any other example mode and is not limited to the example mode in which the protrusion is brought into contact with the rotating member, as long as the structure is provided in which the protrusion prevents the rotation of the rotating member.

Moreover, the foregoing example embodiments refer to the example case where only the developing unit 32 to be attached to the attachment part P1 is held by the image forming apparatus in the first example mode, and the developing unit 32 to be attached to any of the attachment parts P2 to P4 is held by the image forming apparatus in the second example mode; however, the technology is not limited to this example case. Alternatively, the developing unit 32 to be attached to any of the attachment parts P1 and P2 may be held by the image forming apparatus in the first example mode and the developing unit 32 to be attached to any of the attachment parts P3 and P4 may be held by the image forming apparatus in the second example mode, for example. Such allocation of the first and second example modes may be set optionally. Alternatively, the lockout blocks 13 may be provided at respective positions in the toner cartridges 31 that differ from each other depending on the color of the toner. The colors of the toners may be thus allowed to correspond to the respective positions at which the lockout blocks 13 are provided in the toner cartridges 31. The image forming apparatus may have a configuration that allows attachment, to a particular attachment part, of only the image forming unit 30 that has the toner cartridge of a particular color. For example, only the image forming unit 30Y may be attachable to the attachment part P1, only the image forming unit 30M may be attachable to the attachment part P2, only the image forming unit 30C may be attachable to the attachment part P3, and only the image forming unit 30K may be attachable to the attachment part P4. Further, the technology is not limitedly applicable to the example case where assignment of the attachment parts is performed on the basis of the colors. For example, when toners of the same color are made of respective constituent materials different from each other, the assignment of the attachment parts may be performed on the basis of the correspondence between the difference in the constituent materials and the difference in the attachment parts.

Moreover, the foregoing example embodiments refer to the example case of using the exposure unit 53 including a light-emitting diode as a light source; however, the technology is not limited thereto. Alternatively, for example, a device such as a laser device may be used as the light source.

Moreover, the foregoing example embodiments refer to the image forming apparatus having a printing function as an example corresponding to the "image forming apparatus" according to one specific but non-limiting embodiment of the technology. However, the function of the image forming apparatus is not limited thereto. Specifically, for example, the technology is also applicable to an image forming apparatus that serves as a multi-function peripheral having functions such as a scanner function and a facsimile function in addition to the printing function, for example.

Moreover, the foregoing example embodiments refer to an example case where the lockout block 13 and the lockout pin 23 are provided on only one end of the developing unit 32 and one end of the toner cartridge 31, respectively. However, the lockout blocks 13 and the lockout pins 23 may be provided on both ends of the developing unit 32 and both ends of the toner cartridge 31, respectively.

Furthermore, the technology encompasses any possible combination of some or all of the various embodiments and the modifications described herein and incorporated herein.

It is possible to achieve at least the following configurations from the above-described example embodiments of the technology.

(1)

A developing unit including:

a body; and a displacement member that is to be held by the body in a first mode in a first mounting state, and is to be held by the body displaceably between the first mode and a second mode in a reversible fashion in a second mounting state, the first mounting state being a state in which a first toner cartridge is mounted on the developing unit, the second mounting state being a state in which a second toner cartridge is mounted on the developing unit.

(2)

The developing unit according to (1), in which the displacement member is a rotating member that is rotatable around a first rotation axis in both a first rotation direction and a second rotation direction, the second rotation direction being opposite to the first rotation direction, and the first mode is a mode in which the displacement member rotates in the first rotation direction, and part or all of the displacement member is protruded from the body.

(3)

The developing unit according to (2), in which the first toner cartridge includes a protrusion, and the protrusion limits rotation of the rotating member in the second rotation direction in the first mode.

(4)

The developing unit according to (3), in which the rotating member is in contact with the protrusion in the first mode.

(5)

The developing unit according to any one of (2) to (4), further including a biasing member that biases the rotating member in the first rotation direction.

(6)

The developing unit according to (1) or (2), in which the developing unit is mountable on an image forming apparatus including a first attachment part and a second attachment part, the displacement member is to be held by the image forming apparatus in the first mode in a first attachment state in which the developing unit is attached to the first attachment part of the image forming apparatus, and the displacement member is to be held by the image forming apparatus in the second mode in a second attachment state in which the developing unit is attached to the second attachment part of the image forming apparatus.

(7)

An image forming unit including:

a toner cartridge; and a developing unit that allows the toner cartridge to be mounted on the developing unit detachably, the developing unit including a body, and a displacement member that is to be held by the body in a first mode in a mounting state, and is to be held by the body displaceably between the first mode and a second mode in a reversible fashion in a detached state, the mounting state being a state in which the toner cartridge is mounted on the developing unit, the detached state being a state in which the toner cartridge is detached from the developing unit.

(8)

The image forming unit according to (7), in which the displacement member is a rotating member that is rotatable around a first rotation axis in both a first rotation direction and a second rotation direction, the second rotation direction being opposite to the first rotation direction, and the first mode is a mode in which the displacement member rotates in the first rotation direction, and part or all of the displacement member is protruded from the body.

(9)

The image forming unit according to (8), in which the toner cartridge includes a protrusion, and the protrusion limits rotation of the rotating member in the second rotation direction in the first mode.

(10)

The image forming unit according to (9), in which the rotating member is in contact with the protrusion in the first mode.

(11)

The image forming unit according to any one of (8) to (10), further including a biasing member that biases the rotating member in the first rotation direction.

(12)

An image forming apparatus including:

a first developing unit that allows a first toner cartridge to be mounted on the first developing unit detachably; and a frame including a first attachment part that allows the first developing unit to be attached to the first attachment part detachably, the first developing unit including a first body, and a first displacement member that is to be held by the first body in a first mode in a first mounting state, and is to be held by the first body displaceably between the first mode and a second mode in a reversible fashion in a detached state, the first mounting state being a state in which the first toner cartridge is mounted on the first developing unit, the detached state being a state in which the first toner cartridge is detached from the first developing unit.

(13)

The image forming apparatus according to (12), further including a second developing unit that allows a second toner cartridge to be mounted on the second developing unit detachably, the second developing unit including a second body, and a second displacement member that is to be held by the second body displaceably between a third mode and a fourth mode in a reversible fashion in a second mounting state, the second mounting state being a state in which the second toner cartridge is mounted on the second developing unit, in which the frame further includes a second attachment part that allows the second developing unit to be attached to the second attachment part detachably.

(14)

The image forming apparatus according to (12) or (13), in which the first developing unit and the second developing unit have respective structures that are substantially same with each other.

The developing unit according to one embodiment of the technology has a configuration in which the displacement member is held by the body in the first mode, in the first mounting state in which the first toner cartridge is mounted on the developing unit. Hence, for example, upon being mounted on the image forming apparatus, the developing unit on which the first toner cartridge is mounted may not be attachable to the attachment part, of the image forming apparatus, that allows for attachment of the toner cartridge having the displacement member in the second mode. In other words, the developing unit having the displacement member held in the first mode is prevented from being erroneously attached to the attachment part to which that developing unit should not be attached.

The image forming unit according to one embodiment of the technology has a configuration in which the displacement member is held by the body in the first mode, in the mounting state in which the toner cartridge is mounted on the image forming unit. Hence, for example, upon being mounted on the image forming apparatus, the image forming unit in which the toner cartridge is mounted on the developing unit may not be attachable to the attachment position, of the image forming apparatus, to which the image forming unit having the displacement member in the second mode is attachable. In other words, the image forming unit having the displacement member held in the first mode is prevented from being erroneously attached to the position to which that image forming unit should not be attached.

The image forming apparatus according to one embodiment of the technology has a configuration in which the displacement member is held by the body in the first mode, in the first mounting state in which the first toner cartridge is mounted on the developing unit. Hence, for example, upon being mounted on the image forming apparatus, the developing unit on which the first toner cartridge is mounted may not be attachable to the attachment position, of the image forming apparatus, to which the developing unit having the displacement member in the second mode is attachable. In other words, the developing unit having the displacement member held in the first mode is prevented from being erroneously attached to the attachment position at which that developing unit should not be attached.

According to the developing unit of one embodiment of the technology, the displacement member is to be held by the body in a predetermined mode in accordance with the mounting state of the toner cartridge. It is therefore possible to perform favorable image formation when the developing unit of one embodiment of the technology is mounted on the image forming unit or the image forming apparatus.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A developing unit comprising:

a body; and a displacement member that is to be held by the body in a first mode in a first mounting state, and is to be held by the body displaceably between the first mode and a second mode in a reversible fashion in a second mounting state, the displacement member comprising a rotating member that is rotatable around a first rotation axis in both a first rotation direction and a second rotation direction, the second rotation direction being opposite to the first rotation direction, the first mode being a mode in which the displacement member rotates in the first rotation direction, and part or all of the displacement member is protruded from the body, and the first mounting state being a state in which a first toner cartridge is mounted on the developing unit, the first toner cartridge including a protrusion which limits rotation of the rotating member in the second rotation direction in the first mode, the second mounting state being a state in which a second toner cartridge is mounted on the developing unit.

2. The developing unit according to claim 1, wherein the rotating member is in contact with the protrusion in the first mode.

3. The developing unit according to claim 1, further comprising a biasing member that biases the rotating member in the first rotation direction.

4. The developing unit according to claim 1, wherein the developing unit is mountable on an image forming apparatus including a first attachment part and a second attachment part, the displacement member is to be held by the image forming apparatus in the first mode in a first attachment state in which the developing unit is attached to the first attachment part of the image forming apparatus, and the displacement member is to be held by the image forming apparatus in the second mode in a second attachment state in which the developing unit is attached to the second attachment part of the image forming apparatus.

5. An image forming apparatus comprising:

a first developing unit in accordance with claim 1 that allows a first toner cartridge to be mounted on the first developing unit detachably; and a frame including a first attachment part that allows the first developing unit to be attached to the first attachment part detachably.

6. The image forming apparatus according to claim 5, further comprising a second developing unit that allows a second toner cartridge to be mounted on the second developing unit detachably, the second developing unit including a second body, and a second displacement member that is to be held by the second body displaceably between a third mode and a fourth mode in a reversible fashion in a second mounting state, the second mounting state being a state in which the second toner cartridge is mounted on the second developing unit, wherein the frame further includes a second attachment part that allows the second developing unit to be attached to the second attachment part detachably.

7. The image forming apparatus according to claim 6, wherein the first developing unit and the second developing unit have respective structures that are substantially same with each other.

8. An image forming unit comprising:

a toner cartridge; and a developing unit that allows the toner cartridge to be mounted on the developing unit detachably, the developing unit including a body, and a displacement member that is to be held by the body in a first mode in a first mounting state, and is to be held by the body displaceably between the first mode and a second mode in a reversible fashion in a second mounting state, the displacement member comprising a rotating member that is rotatable around a first rotation axis in both a first rotation direction and a second rotation direction, the second rotation direction being opposite to the first rotation direction, the first mode being a mode in which the displacement member rotates in the first rotation direction, and part or all of the displacement member is protruded from the body, and the first mounting state being a state in which a first toner cartridge is mounted on the developing unit, the first toner cartridge including a protrusion which limits rotation of the rotating member in the second rotation direction in the first mode, the second mounting state being a state in which a second toner cartridge is mounted on the developing unit.

9. The image forming unit according to claim 8, wherein the rotating member is in contact with the protrusion in the first mode.

10. The image forming unit according to claim 8, further comprising a biasing member that biases the rotating member in the first rotation direction.

11. An image forming apparatus comprising:

a first toner cartridge containing a first toner;

a second toner cartridge containing a second toner;

a developing unit to which both the first toner cartridge and the second toner cartridge are attachable, and that allows one of the first toner cartridge and the second toner cartridge to be attached to the developing unit;

an attachment part to which the developing unit is to be attached; and a displacement member displaceable between a first mode and a second mode, the first mode allowing the developing unit, to which the first toner cartridge is attached, to be attached to the attachment part, the second mode preventing the developing unit, to which the second toner cartridge is attached, from being attached to the attachment part.

12. The image forming apparatus according to claim 11, wherein the displacement member allows the first toner cartridge to be attached to the developing unit that is attached to the attachment part, and the displacement member prevents the second toner cartridge from being attached to the developing unit that is attached to the attachment part.

13. The image forming apparatus according to claim 11, wherein the attachment part accepts attaching of the developing unit to which the first toner cartridge is attached, or attaching of the developing unit to which neither of the first and the second toner cartridges is attached.

14. The image forming apparatus according to claim 11, wherein the displacement member is held by the developing unit.

* * * * *